United States Patent [19]

Hegenbart

[11] 4,105,097

[45] Aug. 8, 1978

[54] LIFT, ESPECIALLY TWO-POST LIFT FOR MOTOR VEHICLES

[75] Inventor: Horst Hegenbart, Bensheim, Schwanheim, Germany

[73] Assignee: Gebr. Hofmann GmbH & Co. KG, Maschinenfabrik, Darmstadt, Germany

[21] Appl. No.: 792,503

[22] Filed: May 2, 1977

[30] Foreign Application Priority Data

Jun. 23, 1976 [DE] Fed. Rep. of Germany ... 7619866[U]

[51] Int. Cl.[2] ..... B66F 7/28

[52] U.S. Cl. ..... 187/8.75; 285/316; 403/85; 403/104

[58] Field of Search ..... 187/8.41, 8.67, 8.74, 187/8.75, 8.47; 248/411, 412; 285/282, 316, 317, DIG. 8, 298, 302, 303; 403/104, 322, 325, 326, 327, DIG. 8, 85

[56] References Cited

U.S. PATENT DOCUMENTS

| | | | |
|---|---|---|---|
| 1,031,637 | 7/1912 | Fischer | 248/412 X |
| 3,351,363 | 11/1967 | Downey et al. | 285/303 |

*Primary Examiner*—Evon C. Blunk
*Assistant Examiner*—James L. Rowland
*Attorney, Agent, or Firm*—Cushman, Darby & Cushman

[57] ABSTRACT

A locking device for a lift having an arm pivotably mounted for horizontal movement about a lifting carriage with two tubular members each pivotably connected at one end to the arm. One of the tubular members extends into a cylindrical housing and is locked thereto by balls mounted in ball cages urged by a spring to a locking position. The other tubular member is locked to the first tubular member by similar balls, cages and spring. A sleeve longitudinally slidably exterior to the two tubular members includes pins for engaging the ball cages to release the two tubular members.

2 Claims, 2 Drawing Figures

LIFT, ESPECIALLY TWO-POST LIFT FOR MOTOR VEHICLES

BRIEF DESCRIPTION OF THE BACKGROUND OF THE INVENTION AND SUMMARY OF THE INVENTION

The invention relates to a lift, especially a two-post lift for motor vehicles, with one lifting carriage attached to each post, capable of being lifted and lowered in a vertical direction and provided with horizontally slewable supporting arms which support a motor vehicle and including a slewing lock, whereby a laterally displaced slewable clamping bar is provided which is mounted on the lifting carriage on one side and on the supporting arm on the other side.

A lift of this general type is described in an application for a German utility patent G 76 10 847. With this lift, each supporting arm is provided with a clamping bar which can be swung around an axle or a fulcrum respectively laterally displaced with respect to the pivotal point of the supporting arm and which has a clamping device consisting of two clamping plates, each of which features a borehole or opening.

One disadvantage of this arrangement is that the operator has to release the locking system with one hand and swing round the supporting arm with the other hand. As this swing movement must be partly carried out beneath the motor vehicle to be raised, this is a very complicated and time-consuming procedure.

Such a locking system is required for safety reasons, in order to prevent unintentional swing movements. A supporting arm which is possibly not loaded during lifting due to any circumstances or load shifts must be prevented from swinging to the outside owing to percussions or impacts, while work is done on the lift, so that the vehicle is supported at three points only and may tumble down in the event of the smallest load shift.

It is an aim of the present invention to produce a lift, the locking system of which can be released quickly and easily so that it is possible to swing around the supporting arm, whereby the slewing lock of the supporting arms prevents unintentional swing movements in a horizontal plane.

This aim is achieved according to the invention in that the clamping bar is telescopic and force-clamped by means of reciprocally acting springs through clamping bodies, and in that a sliding piece is provided which releases the one clamping body series in each case when actuated in one direction, so that the supporting arm can then be swung in the desired direction by moving the sliding piece further.

The invention is now explained in detail with the aid of a practical example.

DETAILED DESCRIPTION OF THE DRAWINGS

Figure 1:
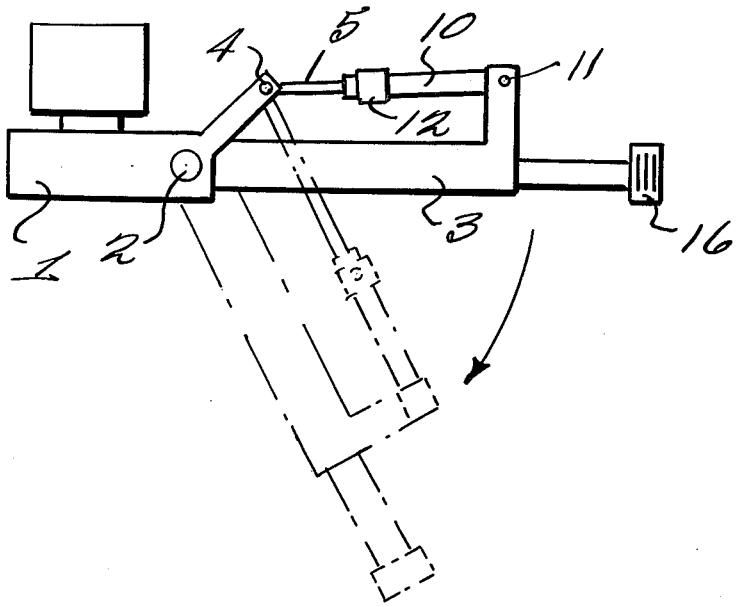
FIG. 1 shows a top view on one supporting arm of a two-post lift.

A lift, especially a two-post lift of which the apparatus for only one post is shown, is equipped with a lifting carriage 1 which can be raised and lowered with the aid of known, and, therefore, not shown, means. On the lifting carriage 1 two horizontally slewable supporting arms are preferably provided of which only one supporting arm 3 is shown. The supporting arm 3 is pivoted to the lifting carriage 1 about fulcrum 2. Supporting arm 3 is in particular telescopic and provided with a take-up plate 16.

Laterally displaced with respect to the supporting arm 3 is a clamping bar consisting of a bolt 5 and a tube 10, which is on one side mounted in the fulcrum 4 on the lifting carriage 1 and on the other side in the fulcrum 11 on the supporting arm 3.

The fulcrums 4 and 11 are provided at constructionally favorable points and arranged in such a way that during slewing of the supporting arm 3 a relative movement arises between bolt 5 and tube 10.

Figure 2:
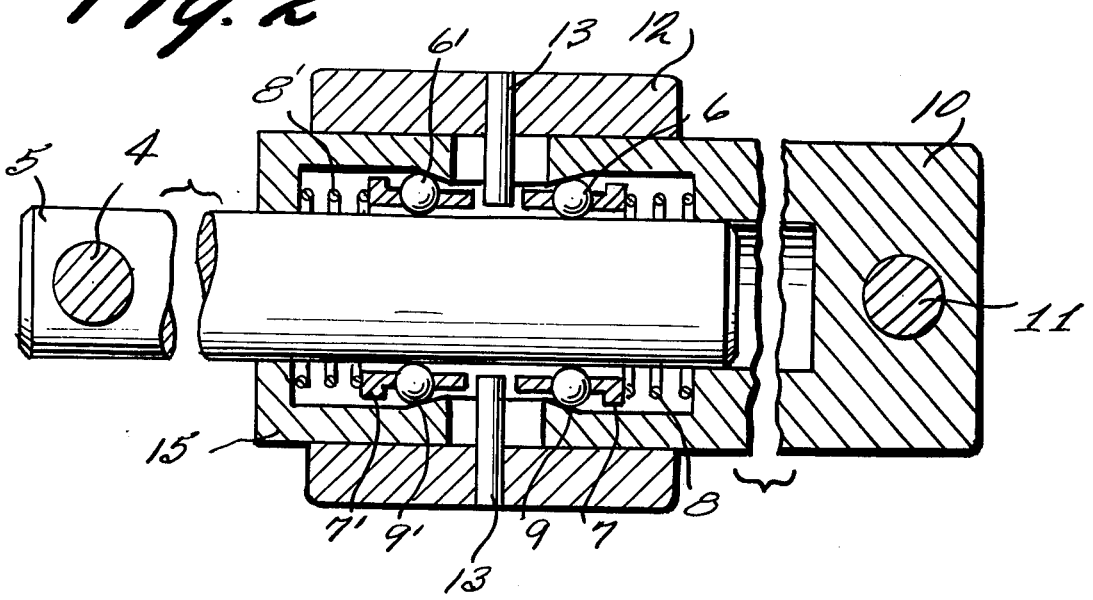
FIG. 2 shows a sectional view of the clamping system according to the present invention.

FIG. 2 shows the clamping device with which on the bolt 5 balls 6 and 6' are pressed on by pressure springs 8 and 8' through ball cages 7 and 7' with the aid of conical surfaces 9 and 9' of housing 15 in such a way that any movement between bolt 5 and tube 10 is prevented.

On tube 10 a sliding piece 12 is provided with preferably two transmission pins 13 extending so far to the inside slots 14 in tube 10 that during axial shifting ball cages 7 and 7' can also be shifted with the aid of these pins.

When the sliding piece 12 is shifted to the right, the pins 13 shift the ball cage 7 to the right, too, and the ball series 6 reduces or eliminates the force contact between tube 10 and bolt 5. When the pins 13 abut against the right end of the grooves 14, the tube 10 is also shifted to the right and thus the supporting arm 3 is swung to the inside. The ball series 6' does not prevent this movement as it is released from the force contact owing to the friction in this direction. Immediately after the sliding piece 12 has been set free, it returns to mid-position and the clamping by force contact exists again in both directions. This procedure is also possible analogously in the opposite direction.

Owing to the device according to the invention, the operator only has to touch the sliding piece 12 with one hand in order to swing around the supporting arm 3. Furthermore, it is ensured that the locking system functions again immediately after the sliding piece 12 has been set free.

This device can be further improved, especially with regard to its service lift, by inserting the flexible member, e.g., a rubber part, between the two pivot fulcrums 4 and 11. This offers the advantage that during raising of the load, lateral shifts of the take-up points caused by deformations in the vehicle or on the lift, can be absorbed elastically.

For this purpose, flexible members can be provided in the bolt 5 and/or in the tube 10. Alternatively, the swing points 4 and 11 can also be mounted resiliently.

In the illustrated example, balls 6, 6' have been chosen as clamping bodies. Other clamping bodies which fulfill the same function, e.g., rollers or special eccentrics can also be used.

Other changes and modifications in the above described embodiment of the invention can be carried out without departing from the scope thereof, and, accordingly, that scope is intended to be limited only by the scope of the appended claims.

What is claimed is:

1. A device for releasably securing two tubular members together comprising:

a cylindrical housing member into which one of said tubular members coaxially extends;

a first plurality of first balls between said cylindrical member and said one tubular member;

second ball cages mounting said first balls for longitudinal movement;

spring means engaging said first ball cages for urging said first cages and balls into a position into which said balls prevent longitudinal motion between said cylindrical member and said one member;

a second plurality of balls between said one tubular member and the other tubular member;

second ball cages mounting said second balls for longitudinal movement;

spring means for engaging said second ball cages and urging said second cages and balls into a position in which said balls prevent longitudinal motion between said tubular members;

a sleeve slidably disposed about said other tubular member and said housing member;

a plurality of pins mounted on said sleeve for sliding movement therewith, said pins engaging said first ball cages when said sleeve is moved in a first longitudinal direction to release said housing and one member and engaging said second ball cages when said sleeve is moved in the opposite direction to release said tubular members.

2. In a lift for motor vehicles having a lifting carriage, an arm pivotably connected to said lifting carriage, said arm having manually operable and releasable means for locking said arm against pivotable movement, said means comprising:

a first tubular member pivotably connected at one end to said carriage;

a second tubular member pivotably connected at one end to said arm;

a third member for slidably receiving the other ends of said first and second members;

a cylindrical housing member into which one of said tubular members coaxially extends;

a first plurality of first balls between said cylindrical member and said one tubular member;

a second ball cages mounting said first balls for longitudinal movement;

spring means engaging said first ball cages for urging said first cages and balls into a position into which said balls prevent longitudinal motion between said cylindrical member and said one member;

a second plurality of balls between said one tubular member and the other tubular member;

second ball cages mounting said second balls for longitudinal movement;

spring means for engaging said second ball cages and urging said second cages and balls into a position into which said balls prevent longitudinal motion between said tubular members;

a sleeve slidably disposed about said other tubular member and said housing member; and a plurality of pins mounted on said sleeve for sliding movement therewith, said pins engaging said first ball cages when said sleeve is moved in a first longitudinal direction to release said housing and one member and engaging said second ball cages when said sleeve is moved in the opposite direction to release said tubular members.

* * * * *